US008670006B2

(12) United States Patent
Hong et al.

(10) Patent No.: US 8,670,006 B2
(45) Date of Patent: Mar. 11, 2014

(54) LOCAL DIMMING DRIVING METHOD AND DEVICE OF LIQUID CRYSTAL DISPLAY DEVICE

(75) Inventors: Hee-Jung Hong, Seoul (KR); Eui-Yeol Oh, Seoul (KR); Si-Hoon Lee, Incheon (KR); Hee-Won Ahn, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 717 days.

(21) Appl. No.: 12/883,321

(22) Filed: Sep. 16, 2010

(65) Prior Publication Data

US 2011/0141090 A1 Jun. 16, 2011

(30) Foreign Application Priority Data

Dec. 14, 2009 (KR) ..... 10-2009-0124281

(51) Int. Cl.
*G09G 5/10* (2006.01)

(52) U.S. Cl.
USPC ..... 345/690; 345/77; 345/89; 345/102; 345/207

(58) Field of Classification Search
USPC ..... 345/690, 102, 211, 204, 87
See application file for complete search history.

(56) References Cited

U.S. PATENT DOCUMENTS

| | | | | |
|---|---|---|---|---|
| 2007/0002000 | A1* | 1/2007 | Kwon | 345/102 |
| 2008/0042927 | A1* | 2/2008 | Jung et al. | 345/39 |
| 2008/0094346 | A1 | 4/2008 | De Greef | |
| 2008/0111782 | A1* | 5/2008 | Shin et al. | 345/99 |
| 2008/0150433 | A1 | 6/2008 | Tsuchida et al. | |
| 2009/0303171 | A1 | 12/2009 | Chang et al. | |
| 2010/0066752 | A1* | 3/2010 | Watanuki | 345/589 |
| 2010/0156777 | A1* | 6/2010 | Kang et al. | 345/102 |

FOREIGN PATENT DOCUMENTS

| | | | |
|---|---|---|---|
| CN | 1920641 | A | 2/2007 |
| KR | 10-2007-0009681 | A | 1/2007 |
| KR | 10-2008-0042956 | A | 5/2008 |
| KR | 10-2008-0060171 | A | 7/2008 |
| KR | 10-2009-0126337 | A | 12/2009 |

OTHER PUBLICATIONS

Chinese Office Action issued in corresponding Chinese Patent Application No. 201010295551.7 dated May 16, 2012.
Office Action dated May 30, 2013 from the Korean Intellectual Property Office in counterpart Korean Application No. 10-2009-0124281.

* cited by examiner

*Primary Examiner* — Amare Mingistu
*Assistant Examiner* — Gloryvid Figueroa-Gibson
(74) *Attorney, Agent, or Firm* — Morgan, Lewis & Bockius LLP

(57) ABSTRACT

A local dimming driving method of the LCD device includes divisionally driving all of a plurality of blocks of a backlight unit using a maximum luminance signal and measuring luminance per block, setting one of the plurality of blocks as a reference block, detecting luminance deviations between the reference block and the residual blocks, and setting an offset value per block for compensating for the detected luminance deviations per block, analyzing an input image in units of blocks corresponding to the plurality of blocks of a backlight unit respectively, detecting a representative value per block, and determining a dimming value per block according to the representative value per block, correcting the dimming value per block using the offset value per block, and controlling the luminance of the backlight unit on a block-by-block basis using the corrected dimming value per block.

18 Claims, 7 Drawing Sheets

(A) THE RELATED ART (B) THE PRESENT INVENTION

FIG. 6

| | | | | | | | | | |
|---|---|---|---|---|---|---|---|---|---|
| 471 | 478 | 480 | 479 | 475 | 472 | 472 | 478 | 472 | 475 |
| 469 | 472 | 480 | 474 | 478 | 480 | 482 | 475 | 480 | 479 |
| 477 | 468 | 469 | 473 | 470 | 474 | 476 | 478 | 472 | 473 |
| 474 | 476 | 481 | 480 | 484 | 482 | 479 | 482 | 468 | 478 |
| 467 | 470 | 477 | 481 | 480 | 488 | 479 | 477 | 479 | 480 |
| 469 | 471 | 472 | 479 | 485 | 481 | 481 | 471 | 469 | 477 |
| 474 | 469 | 475 | 472 | 480 | 479 | 480 | 470 | 475 | 481 |
| 469 | 473 | 477 | 483 | 483 | 475 | 474 | 477 | 479 | 472 |

LUMINANCE VALUE PER BLOCK WHEN ALL BLOCKS OF BACKLIGHT UNIT ARE DRIVEN AT MAXIMUM LUMINANCE (100%)

×

| | | | | | | | | | |
|---|---|---|---|---|---|---|---|---|---|
| 0.99 | 0.98 | 0.97 | 0.97 | 0.98 | 0.99 | 0.99 | 0.98 | 0.99 | 0.98 |
| 1.00 | 0.99 | 0.97 | 0.99 | 0.98 | 0.97 | 0.97 | 0.98 | 0.97 | 0.97 |
| 0.98 | 1.00 | 1.00 | 0.99 | 0.99 | 0.99 | 0.98 | 0.98 | 0.99 | 0.99 |
| 0.99 | 0.98 | 0.97 | 0.97 | 0.96 | 0.97 | 0.97 | 0.97 | 1.00 | 0.98 |
| 1.00 | 0.99 | 0.98 | 0.97 | 0.97 | 0.96 | 0.97 | 0.98 | 0.97 | 0.97 |
| 1.00 | 0.99 | 0.99 | 0.97 | 0.96 | 0.97 | 0.97 | 0.99 | 1.00 | 0.98 |
| 0.99 | 1.00 | 0.98 | 0.99 | 0.97 | 0.97 | 0.97 | 0.99 | 0.98 | 0.97 |
| 1.00 | 0.99 | 0.98 | 0.97 | 0.97 | 0.98 | 0.99 | 0.98 | 0.97 | 0.99 |

OFFSET GAIN VALUE PER BLOCK

| | | | | | | | | | |
|---|---|---|---|---|---|---|---|---|---|
| 466 | 468 | 466 | 465 | 466 | 467 | 467 | 468 | 467 | 466 |
| 469 | 467 | 466 | 469 | 468 | 466 | 468 | 466 | 466 | 465 |
| 467 | 468 | 469 | 468 | 465 | 469 | 466 | 468 | 467 | 468 |
| 469 | 466 | 467 | 466 | 465 | 468 | 465 | 468 | 468 | 468 |
| 467 | 465 | 467 | 467 | 466 | 468 | 465 | 467 | 465 | 466 |
| 469 | 466 | 467 | 465 | 466 | 467 | 467 | 466 | 469 | 467 |
| 469 | 469 | 466 | 467 | 466 | 465 | 466 | 465 | 466 | 467 |
| 469 | 468 | 467 | 469 | 469 | 466 | 469 | 467 | 465 | 467 |

LOCAL DIMMING DRIVING METHOD AND DEVICE OF LIQUID CRYSTAL DISPLAY DEVICE

This application claims the benefit of Korean Patent Application No. 10-2009-0124281, filed on Dec. 14, 2009, which is hereby incorporated by reference as if fully set forth herein.

BACKGROUND OF THE INVENTION

1. Field of the Invention

The present invention relates to a Liquid Crystal Display (LCD) device, and more particularly, to a local dimming driving method and device of an LCD device, which is capable of compensating for a luminance deviation between blocks.

2. Discussion of the Related Art

Recently, as an image display device, a flat panel display device such as a Liquid Crystal Display (LCD) device, a Plasma Display Panel (PDP) device, or an Organic Light Emitting Diode (OLED) device is mainly used.

An LCD device includes a liquid crystal panel for displaying an image using a pixel matrix using electrical and optical characteristics of liquid crystal with anisotropy of a refractive index and a dielectric constant, a driving circuit for driving the liquid crystal panel, and a backlight unit for irradiating light to the liquid crystal panel. Each pixel of the LCD device expresses gray scale, by changing a liquid crystal arrangement direction according to a data signal so as to control transmittance of light from the backlight unit through the liquid crystal panel and a polarization plate.

In the LCD device, the luminance of each pixel is determined by a product of the luminance of the backlight unit and light transmittance of liquid crystal according to data. The LCD device uses a backlight dimming method for analyzing an input image, controlling a dimming value so as to control the luminance of the backlight unit and compensating data, in order to improve a contrast ratio and reduce power consumption. For example, a backlight dimming method for reducing power consumption decreases the luminance of the backlight unit by decreasing the dimming value and increases the luminance of the backlight unit by compensating data, thereby reducing power consumption of the backlight unit.

Recently, as a backlight unit, a Light Emitting Diode (LED) backlight unit using an LED as a light source, which has high luminance and low power consumption as compared with existing lamps, is used. Since the LED backlight unit can be controlled according to positions, the LED backlight unit may be driven by a local dimming method of dividing the LED backlight unit into a plurality of light emitting blocks and controlling the luminance of the backlight unit on a block-by-block basis. In the local dimming method, since the backlight unit and a liquid crystal panel are divided into the plurality of blocks, data is analyzed on a block-by-block basis so as to determine a local dimming value, and the data is compensated, it is possible to further improve a contrast ratio and to further reduce power consumption.

Each of the plurality of light emitting blocks of the LED backlight unit includes a plurality of LEDs connected in series. However, in a conventional LED backlight unit, a luminance deviation between blocks occurs due to a characteristic difference between LEDs, an assembly difference between tools, a characteristic difference between optical sheets, or light leakage. Such a luminance deviation between blocks occurs in an edge type backlight unit as well as a direct type backlight unit. In addition, if luminance deviation between blocks is large at the same gray scale, the LCD device may deal with a defect product.

SUMMARY OF THE INVENTION

Accordingly, the present invention is directed to a local dimming driving method and device of a Liquid Crystal Display (LCD) device that substantially obviates one or more problems due to limitations and disadvantages of the related art.

An object of the present invention is to provide a local dimming driving method and device of an LCD device, which is capable of compensating for a luminance deviation between blocks.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a local dimming driving method of a liquid crystal display device includes divisionally driving all of a plurality of blocks of a backlight unit using a maximum luminance signal and measuring luminance per block, setting one of the plurality of blocks as a reference block, detecting luminance deviations between the reference block and the residual blocks, and setting an offset value per block for compensating for the detected luminance deviations per block, analyzing an input image in units of blocks corresponding to the plurality of blocks of a backlight unit respectively, detecting a representative value per block, and determining a dimming value per block according to the representative value per block, correcting the dimming value per block using the offset value per block, and controlling the luminance of the backlight unit on a block-by-block basis using the corrected dimming value per block.

The local dimming driving method may further include analyzing the quantity of light of a light source of a block of the backlight unit and previously storing light profile data in a memory, calculating a gain value by light quantity analysis using the light profile data and the dimming value per block, and compensating the input data using the calculated gain value.

The reference block may be a block with a lowest luminance value of the plurality of blocks driven using the maximum luminance signal.

The offset value per block may be an offset dimming value indicating a duty ratio of a Pulse Width Modulation (PWM) signal in correspondence with a difference between the luminance value of the reference block and the luminance value of each block, and the offset dimming value per block may be subtracted from the dimming value per block so as to correct the dimming value per block.

The offset value per block may be an offset gain value calculated by a ratio of the luminance value of the reference block to the luminance value of each block, and the dimming value per block may be multiplied by the offset gain value per block so as to correct the dimming value per block.

The backlight unit may be a direct or edge type backlight unit.

In another aspect of the present invention, a method of driving a liquid crystal display device includes supplying the compensated data to a liquid crystal panel using the local dimming driving method as recited above, and displaying the input image data by a combination of the luminance of the backlight unit controlled on the block-by-block basis and light transmittance controlled by the compensated data on the liquid crystal panel.

In another aspect of the present invention, a local dimming driving device of a liquid crystal display device includes a memory in which an offset value per block is previously stored in order to drive all of a plurality of blocks of a backlight unit using a maximum luminance signal, to measure luminance deviations between a reference block and the residual blocks, and to compensate for the detected luminance deviations per block, an image analyzer analyzing an input image in units of blocks and detecting a representative value per block, a dimming value decider determining a dimming value per block according to the representative value per block from the image analyzer, and a dimming value corrector correcting the dimming value per block from the dimming value decider using the offset value per block from the memory.

The memory may further store light profile data obtained by analyzing the quantity of light of a light source of a block of the backlight unit, and the local dimming driver may further include a gain value calculator calculating a gain value by light quantity analysis using the light profile data from the memory and the dimming value per block from the dimming value decider, and a data compensator compensating the input data using the calculated gain value.

In another aspect of the present invention, a liquid crystal display device includes the local dimming driver as recited above, a panel driver supplying the compensated data from the local dimming driver to a liquid crystal panel, a timing controller outputting the compensated data from the local dimming driver to the panel driver and controlling driving timing of the panel driver, a backlight unit including a plurality of blocks to irradiate light to the liquid crystal panel, and a backlight driver driving the light emitting blocks using the dimming value per block from the local dimming driver.

The local dimming driver is built in the timing controller.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 6 is a diagram showing the case where a luminance value per block is corrected by applying an offset gain value according to the local dimming driving method according to the present invention.

DETAILED DESCRIPTION OF THE INVENTION

Reference will now be made in detail to the preferred embodiments of the present invention, examples of which are illustrated in the accompanying drawings.

Figure 1:
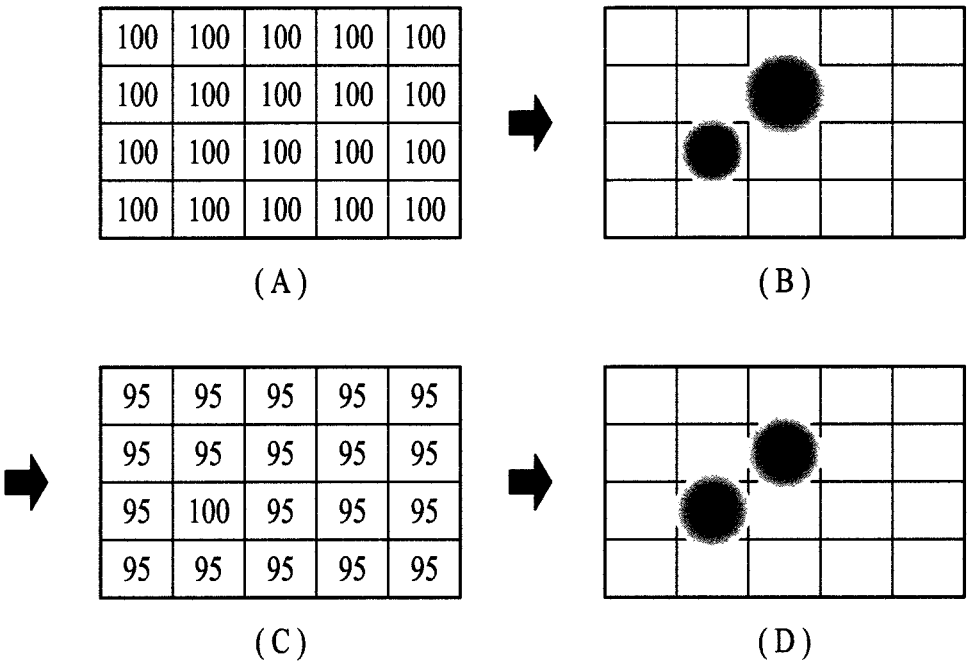
FIG. 1 is a schematic diagram showing a local dimming method of a direct type backlight unit according to an embodiment of the present invention.

FIG. 1 is a schematic diagram showing a local dimming driving method of a Liquid Crystal Display (LCD) device according to an embodiment of the present invention.

A direct type backlight unit shown in FIG. 1 includes a Light Emitting Diode (LED) array, which faces an overall display area of a liquid crystal panel and irradiates light, as a light source. The LED array of the direct type backlight unit is driven in a state of being divided into a plurality of blocks LB, and the luminance thereof is controlled in units of blocks LB. In order to measure a luminance deviation between blocks LB due to a characteristic difference between LEDs, an assembly difference between tools, a characteristic difference between optical sheets, or light leakage, all the blocks LB of the backlight unit are driven by a Pulse Width Modulation (PWM) signal with maximum luminance (that is, a dimming value of 100%) as shown in FIG. 1(A), and the luminance of all the blocks LB is measured on a block-by-block basis as shown in FIG. 1(B).

Next, a block with lowest luminance when each block LB is driven with maximum luminance (100%) is set as a reference block, and luminance deviations between the reference block and the residual blocks are detected. It is set an offset value per block for compensating for the detected luminance deviations per block. The offset value may be set to an offset dimming value indicating a duty ratio of a PWM signal or an offset gain value. The offset dimming value may be set in correspondence with a difference between the luminance value of the reference block and the luminance value of each block, and the offset gain value may be calculated by a ratio of the luminance value of the reference block to the luminance value of each block.

Subsequently, the offset value per block is applied to the dimming value of each block LB so as to correct the dimming value of each block LB as shown in FIG. 1(C). For example, when the reference block with the lowest luminance is driven with maximum luminance (100%) as shown in FIG. 1(C), the dimming value of each block is reduced by the offset value per block such that the luminance deviation between each block and the reference block is reduced. Accordingly, the luminance deviation between the blocks LB is compensated so as to secure luminance uniformity of the blocks as shown in FIG. 1(D).

Figure 2:
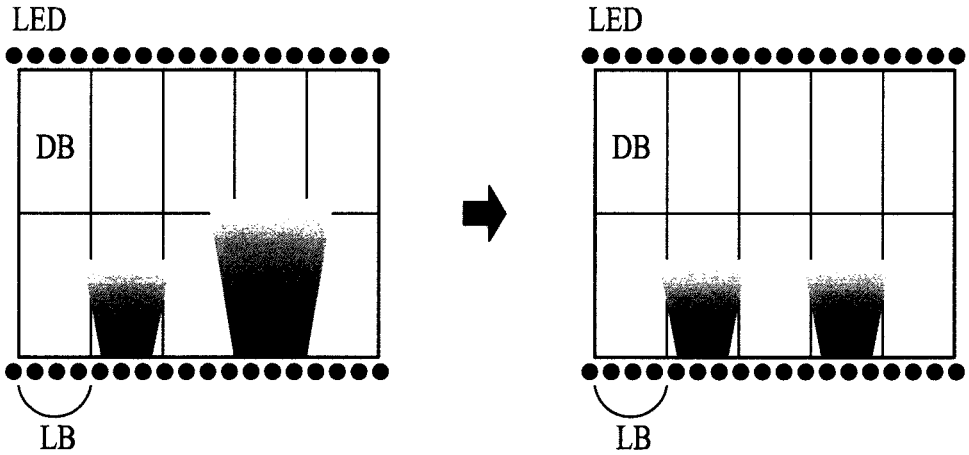
FIG. 2 is a diagram showing an edge type backlight unit applied to the present invention.

In addition, the local dimming method of the present invention is applicable to an edge type backlight unit shown in FIG. 2 as well as the direct type backlight unit shown in FIG. 1. The edge type backlight unit includes an LED array for irradiating light along at least one of four edges surrounding a display area of a liquid crystal panel as a light source. The edge type backlight unit converts the light irradiated from the LED array into surface light through a light guide plate and supplies the surface light to the display area of the liquid crystal panel. FIG. 2 is a diagram showing a backlight unit in which LED arrays are arranged on upper and lower edges of the display area. The LED arrays of the edge type backlight unit are driven in a state of being divided into a plurality of light emitting blocks LB corresponding to a plurality of display blocks DB of the display area, and the luminance thereof is controlled in units of light emitting blocks LB.

Even in the edge type backlight unit shown in FIG. 2, all the light emitting blocks LB are driven at maximum luminance, a light emitting block LB corresponding to a display block DB with lowest luminance is set to a reference block, and luminance deviations between the reference block and the residual blocks are detected. An offset value per block for compensating for the luminance deviation per block is set, and the offset value per block is applied to a dimming value of each light emitting block LB so as to correct a dimming value per block LB. Accordingly, the luminance deviation between the display blocks DB is compensated so as to secure luminance uniformity of the blocks, as shown in FIG. 2(B).

Figure 3:
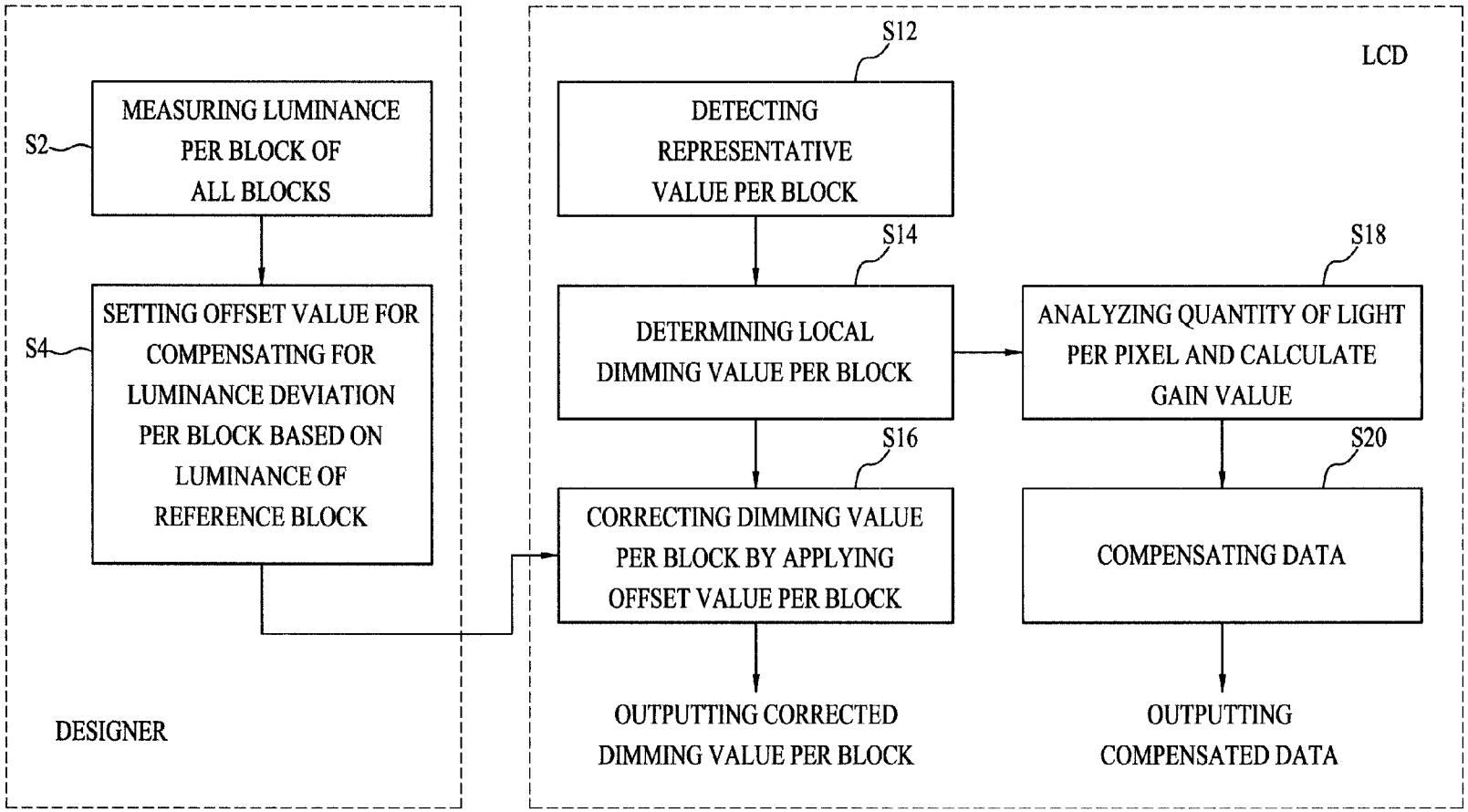
FIG. 3 is a flowchart illustrating a local dimming driving method of a Liquid Crystal Display (LCD) device according to an embodiment of the present invention.

FIG. 3 is a flowchart illustrating a local dimming driving method of a Liquid Crystal Display (LCD) device according to an embodiment of the present invention.

In step 2 (S2), a designer drives all blocks LB of a backlight unit using a PWM signal with a maximum luminance value, that is, a dimming value of 100%, and measures the luminance of each of the blocks LB.

In step 4 (S4), the designer sets a block with a lowest luminance value when each block LB is driven with the maximum luminance value (100%) as a reference block, and detects luminance deviations between the reference block and the residual blocks. An offset value per block for compensating for the detected luminance deviation per block is set. The offset value is set to a dimming value indicating a duty ratio of a PWM signal or an offset gain value, and the offset value per block is stored in a memory in the form of a look-up table.

In step 12 (S12), the LCD device analyzes an input image of a frame in units of blocks and detects a representative value per block. For example, maximum values per pixel are detected from the input image, the detected maximum values per pixel are divided into units of light emitting blocks, the maximum values per pixel are summed and averaged on a block-by-block basis, and an average value per block is detected as the representative value per block.

In step 14 (S14), the LCD device determines and outputs a local dimming value per block corresponding to the representative value per block. In general, since the local dimming value corresponding to the representative value per block is previously set by the designer and is stored in a memory in the form of a look-up table, the local dimming value corresponding to the representative value per block in the look-up table is selected and output on the block-by-block basis.

In step 16 (S16), the dimming value per block determined in step 14 (S14) is corrected using the offset value per block set in step 4 (S4), and the corrected dimming value is output such that the luminance deviation between the blocks is compensated. For example, if the offset value per block is an offset dimming value indicating a duty ratio of a PWM signal, the offset dimming value is subtracted from the dimming value per block so as to correct the dimming value per block. If the offset value per block is an offset gain value in a range from 0.1 to 1, the dimming value per block is multiplied by the offset gain value per block so as to correct the dimming value per block. By driving the direct or edge type backlight unit on the block-by-block basis using the corrected dimming value per block, it is possible to the control the luminance of the backlight unit on the block-by-block basis.

In step 18 (S18), first and second total quantities of light reaching a current pixel are calculated using light profile data which is previously set and stored in a memory and the local dimming value per block determined in step 14 (S14), and a gain value is calculated by a ratio of the first total light quantity to the second total light quantity and is output. In the memory, the light profile data of a light source of one block, that is, light quantity data per pixel, is previously set and stored. Using the light quantity data per pixel from the memory, a sum of quantities of light reaching the current pixel from the light sources of a plurality of blocks neighboring the current input pixel when the overall luminance of the backlight unit has a maximum value is calculated as the first total light quantity of the current pixel. The quantities of light reaching the current pixel from the light sources of the plurality of blocks are multiplied by the local dimming value per block and are summed such that the second total quantity of light reaching the current pixel from the plurality of neighboring blocks when the luminance of the backlight unit is controlled on the block-by-block basis according to the local dimming value is calculated. As expressed by Equation 1, the ratio of the first total light quantity to the second total light quantity of the current pixel is calculated and output as the gain value of the current pixel.

Gain value per pixel=(first total light quantity per pixel at maximum backlight luminance)/(second total light quantity per pixel at backlight luminance controlled by local dimming) Equation 1

In step 20 (S20), the input data of the current pixel is multiplied by the calculated gain value so as to compensate for the luminance of the input data per pixel. Thus, the compensated luminance is output.

Figure 4:
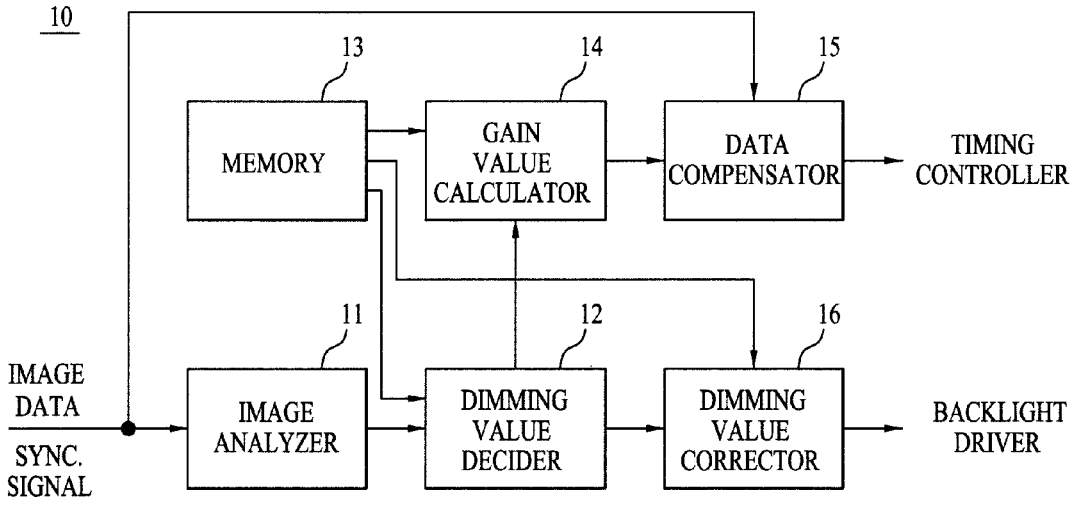
FIG. 4 is a block diagram showing a local dimming driving device of an LCD device of an embodiment of the present invention.

FIG. 4 is a block diagram showing a local dimming driving device of an LCD device of an embodiment of the present invention.

The local dimming driving device 10 shown in FIG. 4 includes an image analyzer 11, a dimming value decider 12, a dimming value corrector 16, a memory 13, a gain value calculator 14, and a data compensator 15.

In the memory 13, an offset value per block which is previously set by a designer is stored in the form of a look-up table, and a dimming value corresponding to a representative value per block is stored in the form of a look-up table. Light profile data of a light source of one block is previously stored in the memory 13.

The image analyzer 11 analyzes input image data in units of light emitting blocks of a backlight unit, detects a representative value per block, and outputs the representative value per block to the dimming value decider 12. In detail, the image analyzer 11 detects maximum values per pixel from the input image data, divides the detected maximum values per pixel in units of blocks, sums and averages the maximum values per pixel on a block-by-block basis, and detects an average value per block as the representative value per block.

The dimming value decider 12 determines and outputs a local dimming value per block corresponding to the representative value per block from the image analyzer 11. The dimming value decider 12 selects and outputs the dimming value per block corresponding to the representative value per block from the image analyzer 11 using a look-up table in which the characteristics of the dimming value corresponding to the representative value per block stored in the memory 13 are stored.

The dimming value corrector 16 corrects the dimming value per block from the dimming value decider 12 using the offset value per block from the memory 13. For example, if the offset value per block is an offset dimming value indicating a duty ratio of a PWM signal, the dimming value corrector 16 may correct the dimming value per block by subtracting the offset dimming value per block from the dimming value per block. If the offset value per block is an offset gain value in a range from 0.1 to 1, the dimming value corrector 16 may correct the dimming value per block by multiplying the dimming value per block by the offset gain value per block. The corrected dimming value per block is output to a backlight driver such that the luminance of the direct or edge type backlight unit is controlled on the block-by-block basis.

The gain value calculator 14 calculates first total quantity of light and second total quantity of light reaching a current pixel using the light quantity data per pixel from the memory 13 and the local dimming value per block from the dimming value decider 12, and calculates and outputs a gain value by a ratio of the first total light quantity to the second total light quantity. The gain value calculator 14 calculates a sum of quantities of light reaching the current pixel from the light sources of a plurality of blocks neighboring the current input pixel when the overall luminance of the backlight unit has a maximum value, as the first total light quantity of the current pixel. The gain value calculator 14 multiplies quantities of light reaching the current pixel from the light sources of the plurality of blocks by the local dimming value per block and sums the multiplied values such that the second total quantity of light reaching the current pixel from the plurality of neighboring blocks when the luminance of the backlight unit is controlled on the block-by-block basis according to the local dimming value is calculated. The gain value calculator 14 calculates and outputs the ratio of the first total light quantity to the second total light quantity of the current pixel as the gain value of the current pixel.

The data compensator 15 multiplies the input data of the current pixel by the gain value calculated by the gain value calculator 14, compensates the luminance of the current pixel data, and outputs data.

In the local dimming driving method and device of the present invention, in order to compensate for luminance deviation, the dimming value per block is controlled using the predetermined offset value per block so as to prevent the luminance deviation between blocks and to secure luminance uniformity of the backlight unit.

Figure 5:
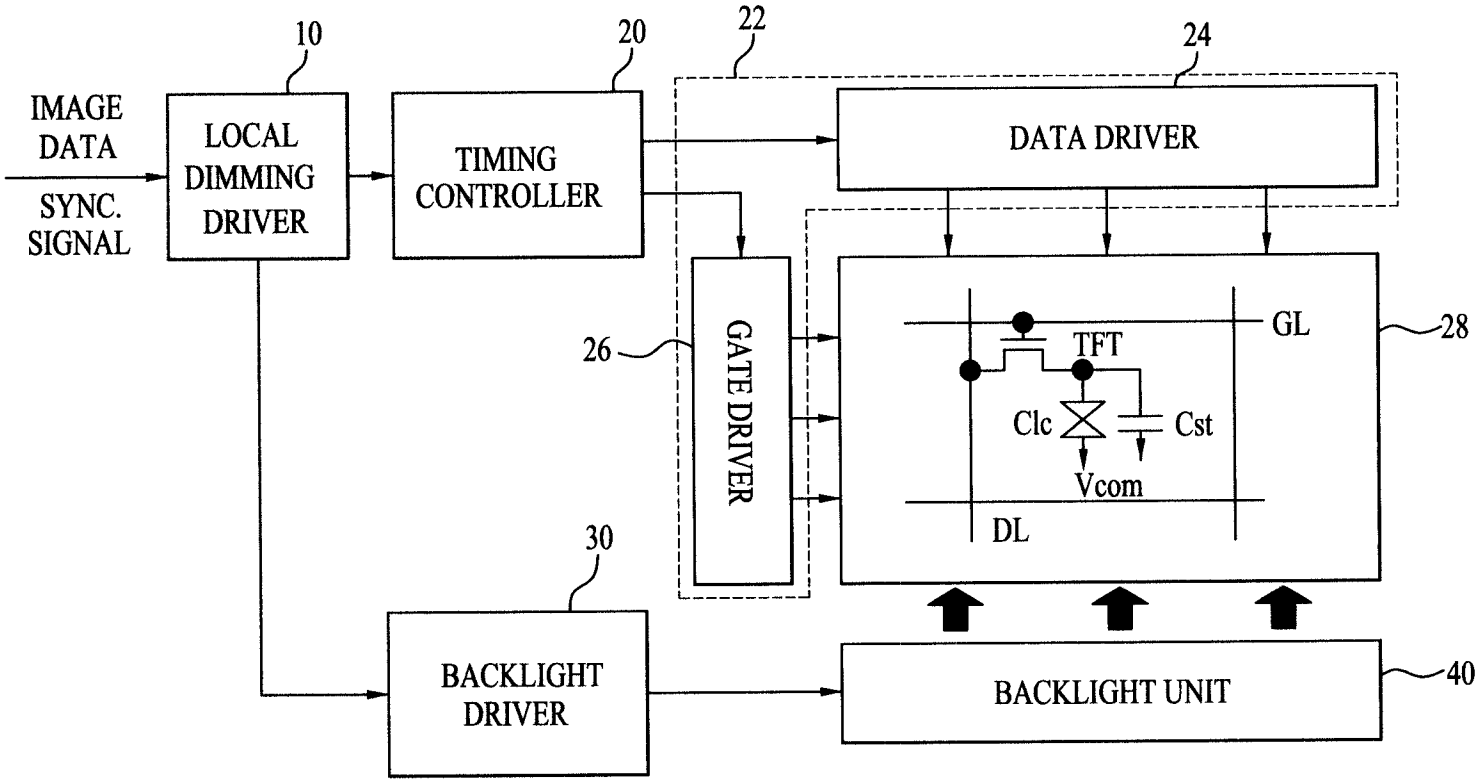
FIG. 5 and FIG. 7 are diagrams showing an LCD device according to embodiments of the present invention.
Figure 7:
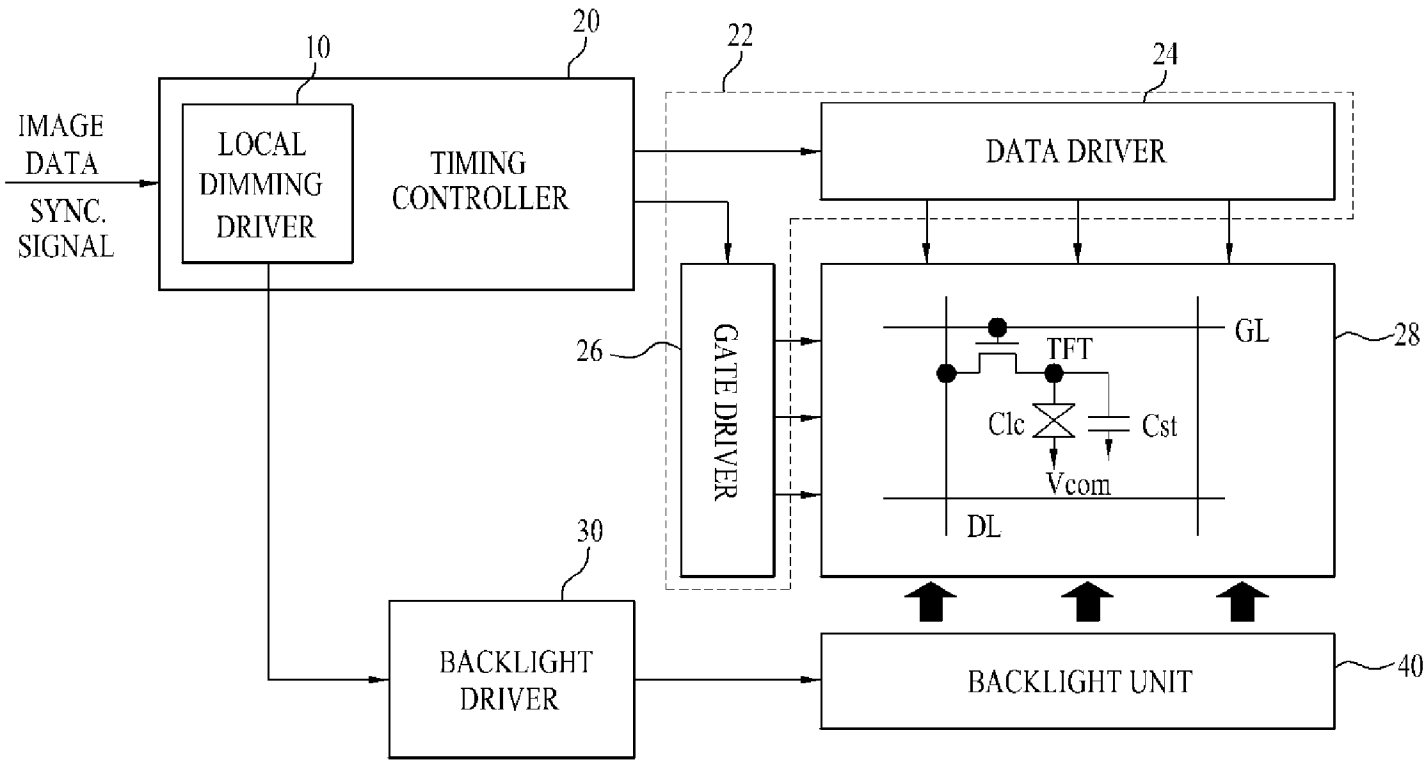

FIG. 5 and FIG. 7 are diagrams showing an LCD device according to embodiments of the present invention, to which the local dimming driving device 10 shown in FIG. 4 is applied.

The LCD device shown in FIG. 5 includes a local dimming driver 10 for analyzing input image data in units of a plurality of blocks, determining a local dimming value, and compensating the data, a timing controller 20 for supplying output data from the local dimming driver 10 to a panel driver 22 and controlling driving timing of the panel driver 22, a backlight driver 30 for driving an LED backlight unit 40 on a block-by-block basis based on the local dimming value per block from the local dimming driver 10, and a liquid crystal panel 28 driven by a data driver 24 and a gate driver 26 of the panel driver 22. The local dimming driver 10 may be built in the timing controller 20 as shown in FIG. 7.

The local dimming driver 10 analyzes data in units of a plurality of blocks using the input image data and a synchronization signal, detects a representative value per block, determines a dimming value corresponding to the representative value per block, and corrects a dimming value per block using an offset value per block which is previously stored in an internal or external memory, and outputs the corrected dimming value to the backlight driver 30. The local dimming driver 10 calculates a gain value by light quantity analysis using the light quantity data per pixel from the memory and the local dimming value per block, compensates the input data by the calculated gain value, and outputs the compensated data to the timing controller 20.

The timing controller 20 aligns the output data from the local dimming driver 10 and outputs the aligned data to the data driver 24 of the panel driver 22. The timing controller 20 generates a data control signal for controlling the driving timing of the data driver 24 and a data control signal for controlling the driving timing of the gate driver 26, using a plurality of synchronization signals, that is, a vertical synchronization signal, a horizontal synchronization signal, a data enable signal and a dot clock, received from the local dimming driver 10, and respectively outputs the data control signal and the gate control signal to the data driver 24 and the gate driver 26. The timing controller 20 may further include an over-driving circuit (not shown) for adding an overshoot value or an undershoot value according to a data difference between neighboring frames so as to change data, in order to improve response time.

The panel driver 22 includes the data driver 24 for driving data lines DL of the liquid crystal panel 28 and the gate driver 26 for driving gate lines GL of the liquid crystal panel 28.

The data driver 24 converts digital image data from the timing controller 24 into analog data signal (pixel voltage signal) using a gamma voltage in response to the data control signal from the timing controller 20 and supplies the analog data signal to the data lines DL of the liquid crystal panel 28.

The gate driver 26 sequentially drives the gate lines GL of the liquid crystal panel 28 in response to the gate control signal from the timing controller 20.

The liquid crystal panel 28 displays an image through a pixel matrix in which a plurality of pixels is arranged. Each pixel exhibits a desired color by a combination of red, green and blue sub-pixels for controlling light transmittance by changing liquid crystal arrangement according to the data signal, the luminance of which is compensated. Each sub-pixel includes a Thin-Film Transistor (TFT) connected to each gate line GL and data line DL, a liquid crystal capacitor Clc connected to the TFT in parallel, and a storage capacitor Cst. The liquid crystal capacitor Clc charges a differential voltage between the data signal supplied to a pixel electrode through the TFT and a common voltage Vcom supplied to a common electrode and drives the liquid crystal according to the charged voltage so as to control light transmittance. The storage capacitor Cst stably maintains the voltage charged in the liquid crystal capacitor Clc.

The backlight unit 40 is a direct or edge type LED backlight unit and is driven in a state of being divided into a plurality of blocks so as to irradiate light to the liquid crystal panel 28.

The backlight driver 30 drives the backlight unit 40 on the block-by-block basis according to the dimming value per block from the local dimming driver 10 so as to control the luminance of the backlight unit 40 on the block-by-block basis. If the backlight unit 40 is driven in a state of being divided into a plurality of ports, a plurality of backlight drivers 30 for independently driving the plurality of ports may be included. The backlight driver 30 generates a Pulse Width Modulation (PWM) signal with a duty ratio corresponding to a local dimming value and supplies an LED driving signal corresponding to the generated PWM signal on the block-by-block basis, thereby driving the backlight unit on the block-by-block basis. The backlight driver 30 sequentially drives the light emitting blocks using the local dimming value input in the block connection order from the local dimming driver 10 so as to control the luminance of the backlight unit on the block-by-block basis.

Accordingly, the LCD device of the present invention displays the input image data by the product of the backlight luminance controlled on the block-by-block basis and the light transmittance controlled by the compensated data on the liquid crystal panel.

FIG. 6 is a diagram showing the case where the luminance deviation per block of the backlight unit is corrected using an offset gain value per block by the local dimming driving method of the LCD device according to the embodiment of the present invention. Referring to FIG. 6, it can be seen that the offset gain value per block is applied to the luminance value per block measured when all the blocks of the backlight unit are driven with a maximum luminance value (100%) so as to correct the luminance value per block. Accordingly, the luminance deviation between the blocks can be minimized.

In the local dimming driving method and device of the liquid crystal display device of the present invention, a luminance deviation between blocks is detected at a maximum luminance value and an offset value for compensating for the luminance deviation is set on a block-by-block basis. In the local dimming driving method of the liquid crystal display device of the present invention, since the dimming value per block determined by block-by-block image analysis is corrected using the offset value per block, it is possible to minimize luminance deviation between blocks at the same gray scale and to improve image quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A local dimming driving method of a liquid crystal display device, the local dimming driving method comprising:

divisionally driving all of a plurality of blocks of a backlight unit using a maximum luminance signal and measuring luminance per block;

setting one of the plurality of blocks as a reference block, detecting luminance deviations between the reference block and the residual blocks, setting an offset value per block for compensating for the detected luminance deviations per block, and storing the offset value per block in a memory;

analyzing input image data in units of blocks corresponding to the plurality of blocks of the backlight unit respectively, detecting a representative value per block, and determining a dimming value per block according to the representative value per block;

correcting the dimming value per block using the offset value per block to output a corrected diming value per block;

controlling the luminance of the backlight unit on a block-by-block basis using the corrected dimming value per block;

analyzing light quantity of a light source of a block of the backlight unit and storing light profile data in the memory;

calculating a gain value using the light profile data from the memory and the dimming value per block; and compensating the input image data using the gain value, wherein:

the gain value is calculated as a ratio between a first total light quantity per pixel when maximum luminance of the backlight unit and a second total light quantity per pixel when luminance of the backlight unit controlled by local dimming, the first total light quantity per pixel is calculated as a sum of light quantities reaching each pixel from the light sources of blocks neighboring the each pixel using the light profile data, when the luminance of the backlight unit has a maximum value, and the second total light quantity per pixel is calculated as a sum of light quantities reaching each pixel from the light sources of blocks neighboring the each pixel using the light profile data and the dimming value per block, when the luminance of the backlight unit is controlled on the block-by-block basis according to the dimming value per block, thereby multiplying the light quantities reaching each pixel from the light sources of blocks neighboring the each pixel by the local dimming value per block to sum multiplied values.

2. The local dimming driving method according to claim 1, wherein the reference block is a block with a lowest luminance value of the plurality of blocks driven using the maximum luminance signal.

3. The local dimming driving method according to claim 2, wherein:

the offset value per block is a duty ratio of a Pulse Width Modulation (PWM) signal in correspondence with a difference between the luminance value of the reference block and the luminance value of each block, and the offset value per block is subtracted from the dimming value per block so as to correct the dimming value per block.

4. The local dimming driving method according to claim 2, wherein:

the offset value per block is a ratio of the luminance value of the reference block to the luminance value of each block, and the dimming value per block is multiplied by the offset value per block so as to correct the dimming value per block.

5. A method of driving a liquid crystal display device, the method comprising:

divisionally driving all of a plurality of blocks of a backlight unit using a maximum luminance signal and measuring luminance per block;

setting one of the plurality of blocks as a reference block, detecting luminance deviations between the reference block and the residual blocks, setting an offset value per block for compensating for the detected luminance deviations per block, and storing the offset value per block in a memory;

analyzing input image data in units of blocks corresponding to the plurality of blocks of the backlight unit respectively, detecting a representative value per block, and determining a dimming value per block according to the representative value per block;

correcting the dimming value per block using the offset value per block to output a corrected diming value per block;

controlling the luminance of the backlight unit on a block-by-block basis using the corrected dimming value per block;

analyzing light quantity of a light source of a block of the backlight unit and storing light profile data in the memory;

calculating a gain value using the light profile data and the dimming value per block;

compensating the input image data using the calculated gain value to output a compensated image data;

supplying the compensated image data to a liquid crystal panel; and displaying the input image data by a combination of the luminance of the backlight unit controlled on the block-by-block basis and light transmittance controlled by the compensated image data on the liquid crystal panel, wherein:

the gain value is calculated as a ratio between a first total light quantity per pixel when maximum luminance of the backlight unit and a second total light quantity per pixel when luminance of the backlight unit controlled by local dimming, the first total light quantity per pixel is calculated as a sum of light quantities reaching each pixel from the light sources of blocks neighboring the each pixel using the light profile data, when the luminance of the backlight unit has a maximum value, and the second total light quantity per pixel is calculated as a sum of light quantities reaching each pixel from the light sources of blocks neighboring the each pixel using the light profile data and the dimming value per block, when the luminance of the backlight unit is controlled on the block-by-block basis according to the dimming value per block, thereby multiplying the light quantities reaching each pixel from the light sources of blocks neighboring the each pixel by the local dimming value per block to sum multiplied values.

6. The method of driving the liquid crystal display device according to claim 5, wherein the reference block is a block with a lowest luminance value of the plurality of blocks driven using the maximum luminance signal.

7. The method of driving the liquid crystal display device according to claim 6, wherein:

the offset value per block is a duty ratio of a Pulse Width Modulation (PWM) signal in correspondence with a difference between the luminance value of the reference block and the luminance value of each block, and the offset value per block is subtracted from the dimming value per block so as to correct the dimming value per block.

8. The method of driving the liquid crystal display device according to claim 6, wherein:

the offset value per block is a ratio of the luminance value of the reference block to the luminance value of each block, and the dimming value per block is multiplied by the offset value per block so as to correct the dimming value per block.

9. A local dimming driving device of a liquid crystal display device, the local dimming driving device comprising:

a memory storing an offset value per block and light profile data, wherein the offset value per block is set as a value to compensate for luminance deviations between a reference block and the residual blocks when all of the plurality of blocks of the backlight unit are driven with maximum luminance, and the light profile data are obtained by analyzing the quantity of light of a light source of a block of the backlight unit;

an image analyzer analyzing input image data in units of blocks corresponding to the plurality of blocks of the backlight unit and detecting a representative value per block;

a dimming value decider determining the dimming value per block according to the representative value per block from the image analyzer;

a dimming value corrector correcting the dimming value per block from the dimming value decider using the offset value per block from the memory;

a gain value calculator calculating a gain value using the light profile data from the memory and the dimming value per block from the dimming value decider; and a data compensator compensating the input image data using the gain value, wherein:

the gain value is calculated as a ratio between a first total light quantity per pixel when maximum luminance of the backlight unit and a second total light quantity per pixel when luminance of the backlight unit controlled by local dimming, the first total light quantity per pixel is calculated as a sum of light quantities reaching each pixel from the light sources of blocks neighboring the each pixel using the light profile data, when the luminance of the backlight unit has a maximum value, and the second total light quantity per pixel is calculated as a sum of light quantities reaching each pixel from the light sources of blocks neighboring the each pixel using the light profile data and the dimming value per block, when the luminance of the backlight unit is controlled on the block-by-block basis according to the dimming value per block, thereby multiplying the light quantities reaching each pixel from the light sources of blocks neighboring the each pixel by the local dimming value per block to sum multiplied values.

10. The local dimming driving device according to claim 9, wherein the reference block is a block with a lowest luminance value of the plurality of blocks driven using the maximum luminance signal.

11. The local dimming driving device according to claim 10, wherein:

the offset value per block is a duty ratio of a Pulse Width Modulation (PWM) signal in correspondence with a difference between the luminance value of the reference block and the luminance value of each block, and the dimming value corrector subtracts the offset value per block from the dimming value per block so as to correct the dimming value per block.

12. The local dimming driving device according to claim 10, wherein:

the offset value per block is a ratio of the luminance value of the reference block to the luminance value of each block, and the dimming value corrector multiplies the dimming value per block by the offset value per block so as to correct the dimming value per block.

13. A liquid crystal display device comprising:

a local dimming driver analyzing input image data, generating a dimming value per block and compensating the input image data;

a panel driver supplying a compensated image data from the local dimming driver to a liquid crystal panel;

a timing controller outputting the compensated image data from the local dimming driver to the panel driver and controlling driving timing of the panel driver;

a backlight unit including a plurality of blocks to irradiate light to the liquid crystal panel; and a backlight driver driving the plurality of blocks using the dimming value per block from the local dimming driver, wherein the local dimming driver comprises:

a memory storing an offset value per block and light profile data, wherein the offset value per block is set as a value to compensate for luminance deviations between a reference block and the residual blocks when all of the plurality of blocks of the backlight unit are driven with maximum luminance, and the light profile data are obtained by analyzing the quantity of light of a light source of a block of the backlight unit;

an image analyzer analyzing the input image data in units of blocks corresponding to the plurality of blocks of the backlight unit and detecting a representative value per block;

a dimming value decider determining the dimming value per block according to the representative value per block from the image analyzer;

a dimming value corrector correcting the dimming value per block from the dimming value decider using the offset value per block from the memory;

a gain value calculator calculating a gain value using the light profile data from the memory and the dimming value per block from the dimming value decider; and a data compensator compensating the input image data using the gain value, wherein:

the gain value is calculated as a ratio between a first total light quantity per pixel when maximum luminance of the backlight unit and a second total light quantity per pixel when luminance of the backlight unit controlled by local dimming, the first total light quantity per pixel is calculated as a sum of light quantities reaching each pixel from the light sources of blocks neighboring the each pixel using the light profile data, when the luminance of the backlight unit has a maximum value, and the second total light quantity per pixel is calculated as a sum of light quantities reaching each pixel from the light sources of blocks neighboring the each pixel using the light profile data and the dimming value per block, when the luminance of the backlight unit is controlled on the block-by-block basis according to the dimming value per block, thereby multiplying the light quantities reaching each pixel from the light sources of blocks neighboring the each pixel by the local dimming value per block to sum multiplied values.

14. The liquid crystal display device according to claim 13, wherein the reference block is a block with a lowest luminance value of the plurality of blocks driven using the maximum luminance signal.

15. The liquid crystal display device according to claim 14, wherein:

the offset value per block is a duty ratio of a Pulse Width Modulation (PWM) signal in correspondence with a difference between the luminance value of the reference block and the luminance value of each block, and the dimming value corrector subtracts the offset value per block from the dimming value per block so as to correct the dimming value per block.

16. The liquid crystal display device according to claim 14, wherein:

the offset value per block is a ratio of the luminance value of the reference block to the luminance value of each block, and the dimming value corrector multiplies the dimming value per block by the offset value per block so as to correct the dimming value per block.

17. The liquid crystal display device according to claim 13, wherein the backlight unit is a direct or edge type backlight unit.

18. The liquid crystal display device according to claim 13, wherein the local dimming driver is built in the timing controller.

* * * * *